US006471498B1

(12) United States Patent
Sakata et al.

(10) Patent No.: US 6,471,498 B1
(45) Date of Patent: Oct. 29, 2002

(54) FLUID MACHINERY HAVING STEPPED SPIRALS WITH AXIAL PUSHING MEANS FOR THE MOVING SPIRAL

(75) Inventors: Hirotsugu Sakata, Tokyo (JP); Makoto Hayano, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/042,455

(22) Filed: Mar. 16, 1998

(30) Foreign Application Priority Data

Mar. 26, 1997 (JP) ..... 9-073849

(51) Int. Cl.[7] ..... F01C 1/04; F01C 19/08

(52) U.S. Cl. ..... 418/55.2; 418/55.4; 418/55.5; 418/55.6

(58) Field of Search ..... 418/55.2, 55.4, 418/55.5, 55.6, 57

(56) References Cited

U.S. PATENT DOCUMENTS 3,994,633 A * 11/1976 Shaffer ..... 418/55.4
4,384,831 A * 5/1983 Ikegawa et al. ..... 418/55.6
4,522,575 A * 6/1985 Tischer et al. ..... 418/55.5
4,645,437 A * 2/1987 Sakashita et al. ..... 418/55.5
4,696,630 A * 9/1987 Sakata et al. ..... 418/57
4,708,607 A 11/1987 Hayano et al. ..... 418/55.5
4,928,503 A * 5/1990 Riffe ..... 418/55.4
5,026,264 A 6/1991 Morozumi et al. ..... 418/220
5,492,460 A * 2/1996 Takeda et al. ..... 418/55.2
5,494,422 A * 2/1996 Ukai et al. ..... 418/55.2
5,551,852 A * 9/1996 Saito et al. ..... 418/55.4
5,603,614 A * 2/1997 Sakata et al. ..... 418/55.2

FOREIGN PATENT DOCUMENTS

JP 9-126168 5/1997

* cited by examiner

*Primary Examiner*—John J. Vrablik
(74) *Attorney, Agent, or Firm*—Foley & Lardner

(57) ABSTRACT

A fluid machinery is provided which comprises a stationary spiral having an inner engaging surface, and a moving spiral having an outer engaging surface which is engaged with the inner engaging surface and is rotated upon an axis line X relatively to the stationary spiral. A working chamber which rises spirally from an outer periphery to a center portion with a reduction in volume can be formed by engaging the outer engaging surface with the inner engaging surface, and the moving spiral can be pushed along the axis line X by use of gas pressure, etc.

22 Claims, 10 Drawing Sheets

FLUID MACHINERY HAVING STEPPED SPIRALS WITH AXIAL PUSHING MEANS FOR THE MOVING SPIRAL

BACKGROUND OF THE INVENTION

1. Field of the Invention

The present invention relates to a fluid machinery which is suitable for the compressor or the pump.

2. Description of the Related Art

In the prior art, as a representative example which is closest to a fluid machinery of the present invention as the compressor, there has been a scroll compressor. The outlines of the configuration and the operation of the scroll compressor may be given as follows. That is, a compression chamber can be formed by engaging a spiral body serving as a stationary scroll with another spiral body serving as a rotating scroll and then rotating the rotating scroll such that a volume of the compression chamber can be reduced sequentially from the outer peripheral portion toward the center portion, then the compressed working fluid can be discharged from the compression chamber to the outside via a discharge port provided on the center portion of the scroll compressor.

Since the scroll compressor compresses the working fluid from its outer portion to its center portion along its radial direction, a compressible volume can be determined by the radius of the rotating scroll. For this reason, according to an increase in the compressible volume, such radius has to be increased and thus the overall scroll compressor is also increased in size. In addition, because an inner surface of one spiral body and an outer surface of another spiral body can serve as an inner engaging surface of the stationary scroll and an outer engaging surface of the rotating scroll respectively, the inner engaging surface of the stationary scroll and the outer engaging surface of the rotating scroll must be finished with high precision. As a result, a working cost has been increased, a longer machining time has been needed, etc., so that the scroll compressor has not been desirable in the aspect of workability.

SUMMARY OF THE INVENTION

Therefore, it is an object of the present invention to provide a highly efficient fluid machinery capable of expanding a compressible volume without an increase in size and suppressing seal leakage smaller by assuring a stable motion of a moving spiral.

In order to overcome the above problems in the prior art and to achieve the object of the present invention, as a preferred embodiment of the present invention, there is provided a fluid machinery comprising a stationary spiral having an inner engaging surface which rises spirally from its inner periphery to its center portion and has a stepwise sectional shape, a moving spiral having an outer engaging surface which rises spirally from its outer periphery to its center portion and has a stepwise sectional shape, and is rotated upon an axis line relatively to the stationary spiral; a working chamber formed from the outer periphery to the center portion by engaging the outer engaging surface of the moving spiral with the inner engaging surface of the stationary spiral so as to have a reduction in volume; and pushing means for pushing the moving spiral along the axis line.

As another preferred embodiment of the present invention, there is provided a fluid machinery comprising a stationary spiral having an inner engaging surface which rises spirally from its inner periphery to its center portion and has a stepwise sectional shape; a moving spiral having an outer engaging surface which rises spirally from its outer periphery to its center portion and has a stepwise sectional shape, and is rotated upon an axis line relatively to the stationary spiral; a working chamber formed from the outer periphery to the center portion by engaging the outer engaging surface of the moving spiral with the inner engaging surface of the stationary spiral so as to have a reduction in volume; a spiral sealing member provided between the inner engaging surface of the stationary spiral and the outer engaging surface of the moving spiral, for sealing a space between the working chamber and the working chamber; and pushing means for pushing the moving spiral along the axis line.

In the fluid machinery of the present invention, the pushing means pushes the moving spiral to the stationary spiral side as a pushing direction.

In the fluid machinery of the present invention, when the moving spiral is pushed by the pushing means, an upper surface of a bearing portion of the moving spiral is received by a lower surface of a bearing portion of the stationary spiral. According to such fluid machinery, when the moving spiral rotates relative to the stationary spiral while the inner engaging surface is being engaged with the outer engaging surface, the working chamber with a reduction in volume from the outer periphery to the center portion can be formed.

In the fluid machinery of the present invention, since the working volume of the working chamber can be determined along the radial direction and the height direction at that time, the large working volume can be obtained irrespective of an increase of the overall fluid machinery in size. At the same time, since the moving spiral is pushed toward the stationary spiral side by the pushing means, a stable rotational motion of the moving spiral upon the axis line can be ensured even when the deviated load is imposed upon the moving spiral. As a result, the inner engaging surface can firmly engage with the outer engaging surface, so that the efficient working chamber which is capable of preventing seal leakage can be implemented.

In this case, the pressure of the gas such as the suction gas, the compression gas, etc.; may be employed as the pushing means. A uniform pushing force can be applied when such gas pressure is guided to the rear surface of the moving spiral circularly or annularly. At that time, it is preferable that the gas pressure in excess of the suction gas pressure should be applied to the rear surface of the moving spiral as the gas pressure.

In the fluid machinery of the present invention, in order to maintain secure sealing for a long period of time, it is desired that the wear resistance material, the sealing member, or the annular member may be provided on the sliding working surface between the outer upper surface of the bearing portion and the inner lower surface of the bearing portion not to leak the compression gas to the crankshaft side.

In the fluid machinery of the present invention, the moving spiral can be pushed toward the anti-stationary spiral side by the pushing means. As conditions at that time, the rear surface of the moving spiral can be received by the annular receiving portion which is provided on the supporting frame. Otherwise, the sealing member or the annular member can be provided on the sliding working surface of the receiving portion, so that secure sealing can be maintained when different gas pressures are guided to the inside and the outside of the receiving portion. Accordingly, since the rear surface of the moving spiral is pushed toward the anti-stationary spiral side in working operation, the moving spiral can be supported by the annular receiving portion even when the deviated load is imposed upon the moving spiral, and therefore a stable rotational motion of the moving spiral upon the axis line can be ensured. As a consequence, the inner engaging surface can engage with the outer engaging surface without fail, so that the efficient working chamber which is able to prevent seal leakage can be implemented.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE PREFERRED EMBODIMENTS

There will be explained a case where a fluid machinery according to embodiments of the present invention is used as a compressor, for example, with reference to the accompanying drawings of FIGS. 1 to 17 hereinafter.

Figure 1:
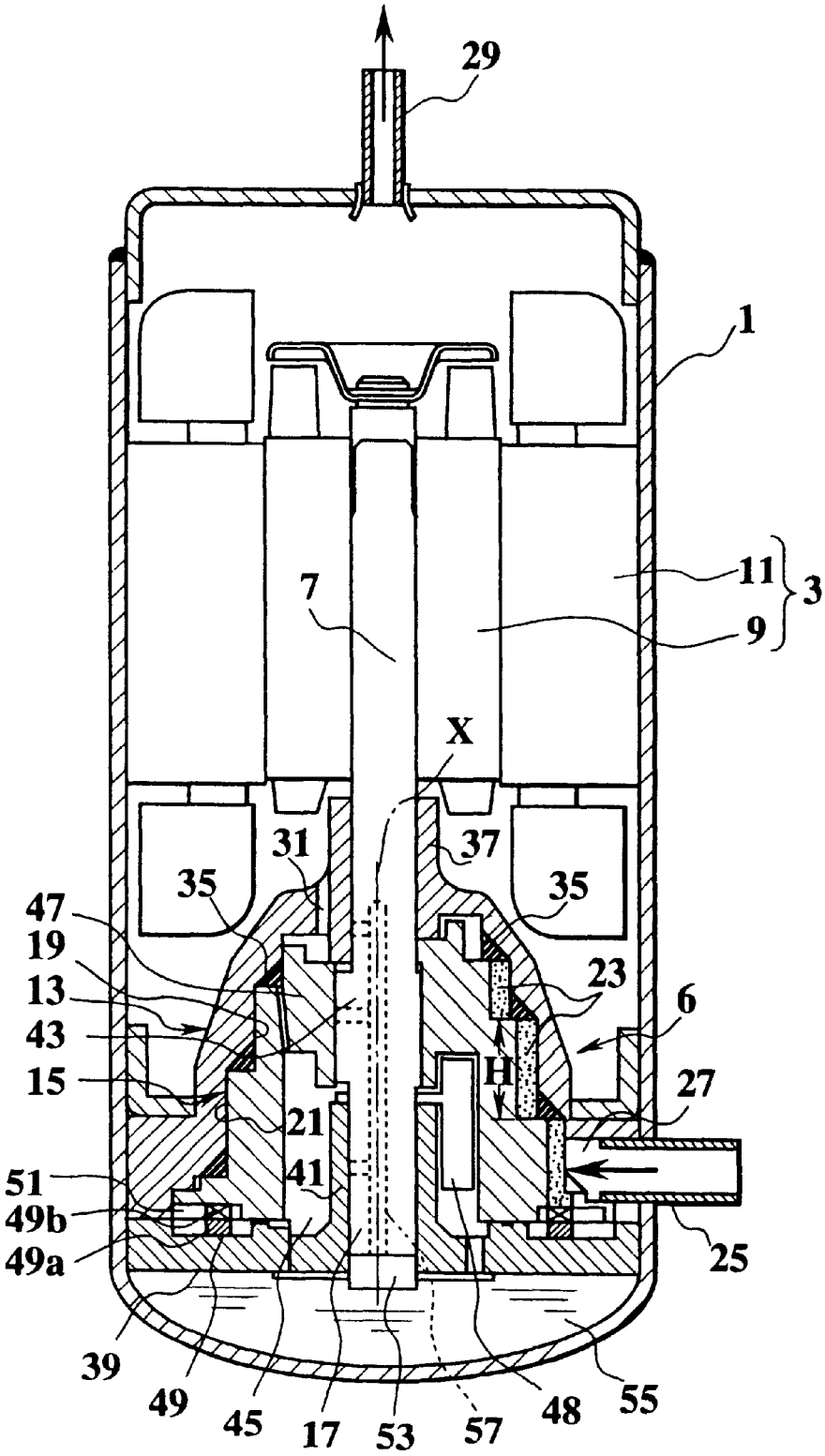
FIG. 1 is a schematic sectional view, partially cut away, showing a fluid machinery according to an embodiment of the present invention.
Figure 2:
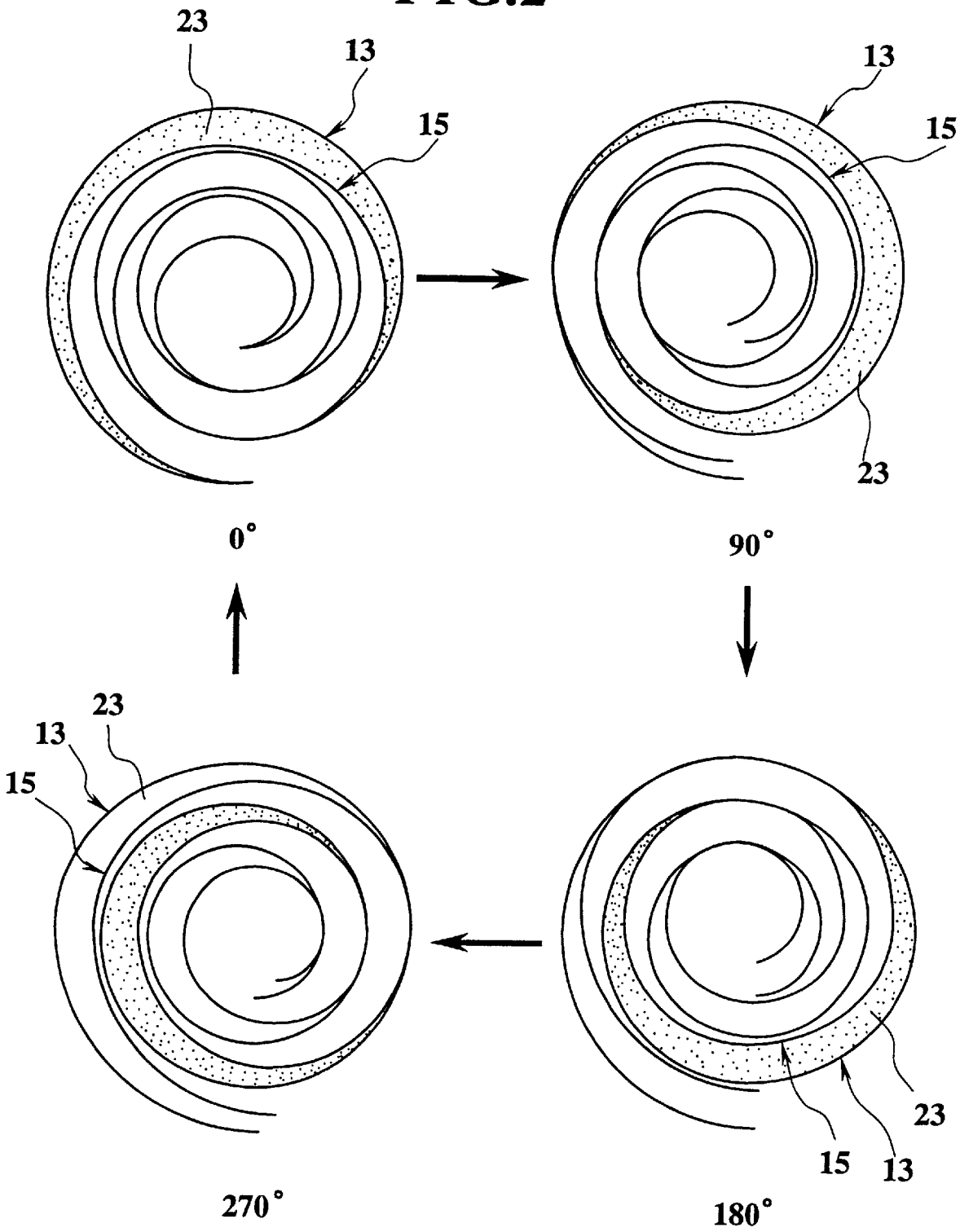
FIG. 2 is a view slowing respective phases in the course of compression process.

In FIG. 1, a reference 1 denotes a hermetic case of a fluid machinery and a driving motor 3 and a compressing mechanism portion 6 are arranged in the hermetic case 1.

The driving motor 3 comprises a rotor 9 which is fixed to a shaft 7 and a stator 11 which is fixed to an inner wall surface of the hermetic case 1. When an electric current is supplied to the stator 11 of the motor 3, a rotating power can be applied to the shaft 7 by the rotor The compressing mechanism portion 6 includes a stationary spiral 13 and a moving spiral 15. A crankshaft 17 which is formed integrally with the shaft 7 is passed through the compressing mechanism portion 6.

The stationary spiral 13 can form a spiral chamber like a spiral staircase. In the spiral chamber, the inner spiral engaging surface 19 radius is gradually reduced as it rises moves upwardly, i.e., rises from an inner periphery toward a center portion of the spiral chamber. The stationary spiral 13 is fixed to the inner wall surface of the hermetic case 1.

The moving spiral 15 has an outer engaging surface 21 on an outer periphery of the spiral body which is formed to rise from an outer periphery toward the center portion like the spiral staircase and whose radius is gradually reduced toward the center portion as it moves upwardly.

When the outer engaging surface 21 of the moving spiral 15 is engaged with the inner engaging surface 19 of the stationary spiral 13, a compression chamber 23 acting as a working chamber can be formed. Therefore, it is to be noted that, with respect to machining precision, only the machining of the outer engaging surface 21 and the inner engaging surface 19 should be managed.

The compression chamber 23 is connected to a suction port 27 and a discharge port 31 respectively. The suction port 27 is directly connected to a suction pipe 25 which is extended to the outside of the hermetic case 1. The discharge port 31 is connected via an internal space of the hermetic case 1 to a discharge pipe 29 which is provided at a top surface portion of the hermetic case 1. As shown in four phases in the middle of compression process in FIG. 2, i.e., 0 degree, 90 degree, 180 degree, and 270 degree of a rotation angle of the moving spiral 15, for example, when a rotational motion is given to the moving spiral 15 to generate a spiral motion of the outer engaging surface 21, the working gas supplied from the suction port 27 can be carried upwardly toward the center portion with a reduction in volume and then be discharged from the discharge port 31.

In this case, it is preferable that a check valve (not shown) is provided in the suction port 27 or the discharge port 31. Hence, when the rotation of the moving spiral 15 is terminated, reverse flow of the gas can be prevented by the check valve.

Figure 3:
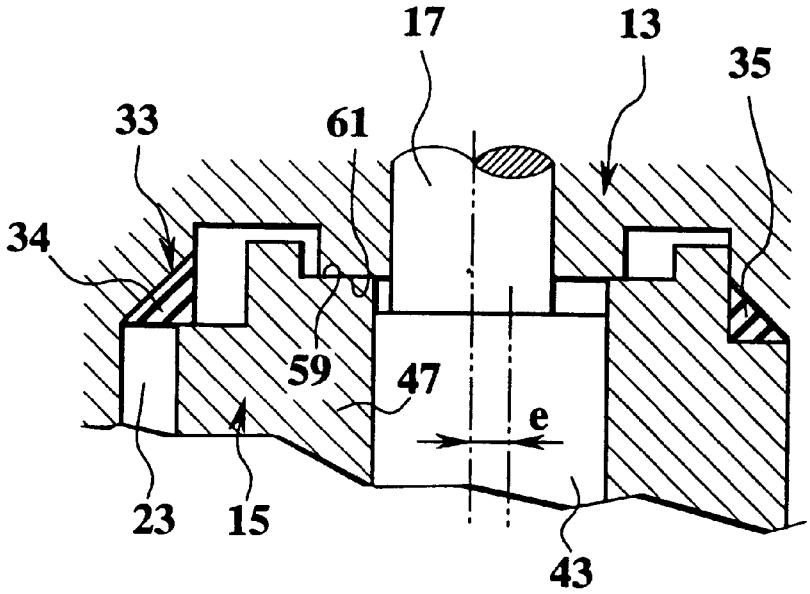
FIG. 3 is an enlarged sectional view showing a pertinent portion wherein an upper surface of a bearing portion of a moving spiral is supported by a lower surface of a bearing portion of a stationary spiral.

The compressible volume of the compression chamber 23 can be determined by a staircase-like pitch H in section as well as another pitch of the spiral in the radial direction. As shown in FIG. 3, sealing of the compression chamber 23 can be assured by a sealing member 35 arranged in a closed space 33. The closed space 33 has a triangular sectional shape, as shown in FIG. 3, which is formed continuously in a spiral manner by both a stepped surface of the inner engaging surface 19 of the stationary spiral 13 shown in FIG. 1 and a stepped surface of the outer engaging surface 21 of the moving spiral 15. As a result, sealing of the compression chamber 23 can be maintained by the sealing member 35.

The crankshaft 17 which is provided so as to pass through the compressing mechanism portion 6 can be supported rotatably at both end portions by a bearing portion 37 of the stationary spiral 13 and a bearing portion 41 of the supporting frame 39 which is fixed to the inner wall surface of the hermetic case 1.

As shown in FIG. 1, to the crankshaft 17 are provided both a crank portion 43 which is eccentrically positioned by a predetermined amount e relative to a center axis line X, and a balancer 48 which is positioned oppositely to the crank portion 43 by 180 degree and is also rotated within an internal space 45. A bearing portion 47 of the moving spiral 13 is inserted rotatably into the crank portion 43. Therefore, if the crank portion 43 is rotated as shown in FIG. 1 a rotational motion ran be given to the moving spiral 15 by means of an Oldam's ring 49 without rotating around on its own axis.

The Oldam's ring 49 is formed to have a structure in which a plurality of projections 49*b* which face to a concave portion 51 provided on a rear surface of the moving spiral 15 are provided to a ring main body 49*a* supported by the supporting frame 39. A lubricating oil 55 collected in the bottom of the hermetic case 1 is supplied to respective bearing portions 37, 41, 47 via a lubrication path 57 by an oil pump 53 which is provided on a lower end portion of the crankshaft 17.

The moving spiral 15 is a constituent member which is pushed toward the stationary spiral 13 by the gas pressure which acts as one of the pushing means.

Respective embodiments wherein the moving spiral 15 is received by the stationary spiral 13 when it is pushed by the gas pressure will be explained with reference to FIGS. 3 to 10 hereunder.

FIG. 3 shows a configuration wherein an upper surface 59 of a bearing portion of the moving spiral 15 is supported by a lower surface 61 of a bearing portion of the stationary spiral 13. FIG. 3 also shows a case where an axial position of the moving spiral 15 is set correctly when the moving spiral 15 is during its rotational motion.

Figure 4:
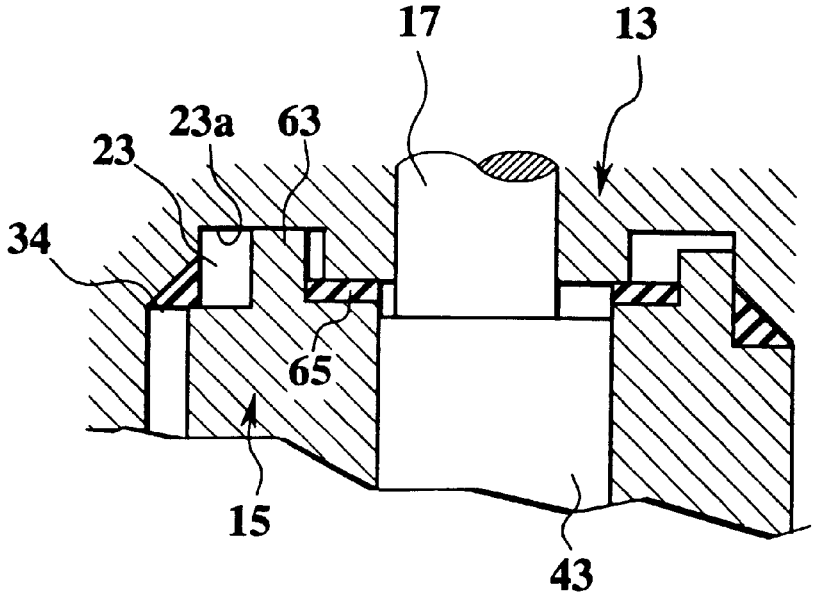
FIG. 4 is an enlarged sectional view showing a pertinent portion wherein leakage of a gas from a compression chamber to the crankshaft side can be prevented by a sealing member at the end of the compression process.

FIG. 4 shows a configuration wherein an annular projection 63 which is brought into contact with a top supporting surface 23*a* of the compression chamber 23 of the stationary spiral 13 to constitute the final compression chamber 23 is provided on a top surface of the moving spiral 15, a sealing member 65 is provided in the inside of the projecting portion 63, and the projecting portion 63 of the moving spiral 15 can be received by the supporting top surface 23*a* of the stationary spiral 13. According to a relationship between the top supporting surface 23*a* and the projecting portion 63, there can be provided a means for setting an axial position correctly during operation and also preventing firmly leakage of the compressed gas toward the crankshaft 43 side at the end of the compression process.

Figure 5:
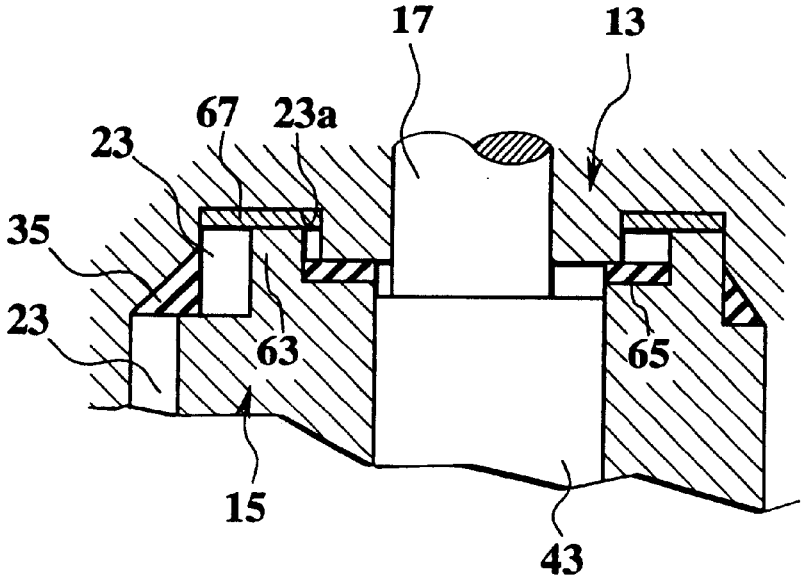
FIG. 5 is an enlarged sectional view showing a pertinent portion wherein wear resistance material is provided on a sliding working surface between an annular projecting portion of the moving spiral and a top supporting surface of the final compression chamber serving as the stationary spiral.

As shown in FIG. 5, in the event of this embodiment, it is preferable that a wear resistance material 67 made of Swedish steel or spring member is provided between the top supporting surface 23*a* of the compression chamber 23 and the annular projecting portion 63. As a result, a sliding working surface can be maintained stably for a long period of time.

Figure 6:
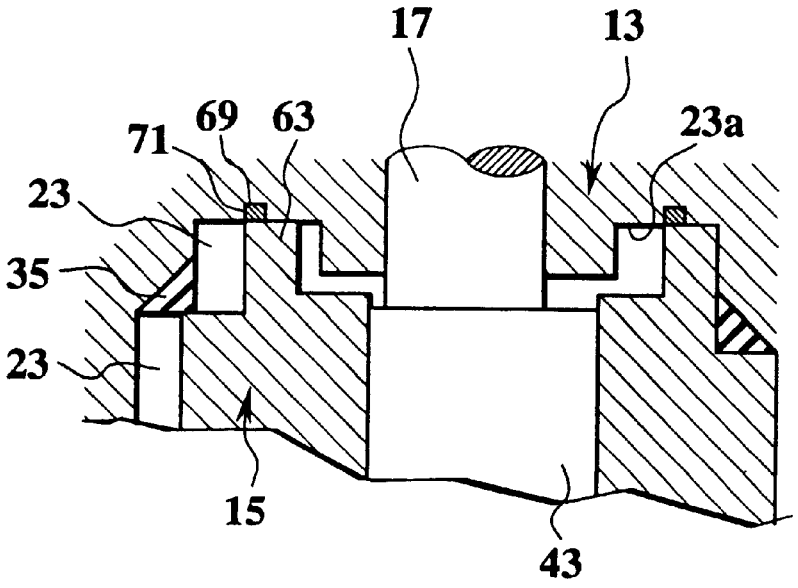
FIG. 6 is an enlarged sectional view showing a pertinent portion wherein an annular member which can prevent leakage of the gas to the crankshaft side at the end of the compression process is provided on the sliding working surface between the annular projecting portion of the moving spiral and the top supporting surface of the final compression chamber serving as the stationary spiral.

FIG. 6 shows another modification of the sealing member 65 shown in FIG. 4, which can prevent the leakage of the compressed gas to the crankshaft 43 side at the end of the compression process. An annular groove 69 is provided on the top supporting surface 23*a* side of the compression chamber 23 and an annular member 71 is then inserted into the annular groove 69. As a consequence, sealing of the sliding working surface between the top supporting surface 23*a* of the stationary spiral 13 and the annular projecting portion 63 of the moving spiral 15 can be assured.

Figure 7:
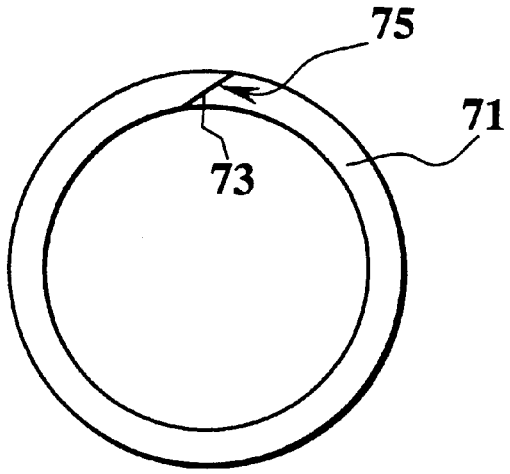
FIG. 7 is a plan view showing the annular member in FIG. 6 having an oblique cut line.
Figure 8:
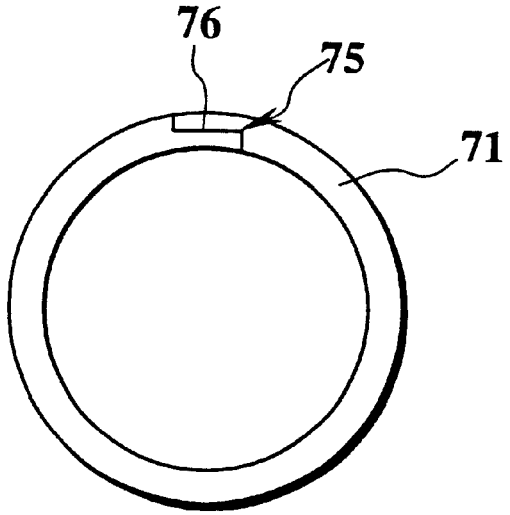
FIG. 8 is a plan view showing the annular member in FIG. 6 having a cut line which is shaped differently from that in FIG. 7.

As shown tin FIG. 7, the annular member 71 is formed like a ring. To the annular member 71 is provided an oblique cut line 75 having opposing contact surfaces 73 which can connect an inner diameter side and an outer diameter side and are always brought into contact with each other when they are expanded/compressed according to the gas pressure. In this case, as shown in FIG. 8, a crank-like cut line 75 may be employed. In this cut line 75 shown in FIG. 8, regions 76 serve as the opposing contact surfaces which always come into contact with each other. According to the annular member 71, it is feasible to prevent surely the leakage of the compressed gas toward the crankshaft 43 side at the end of the compression process.

Figure 9:
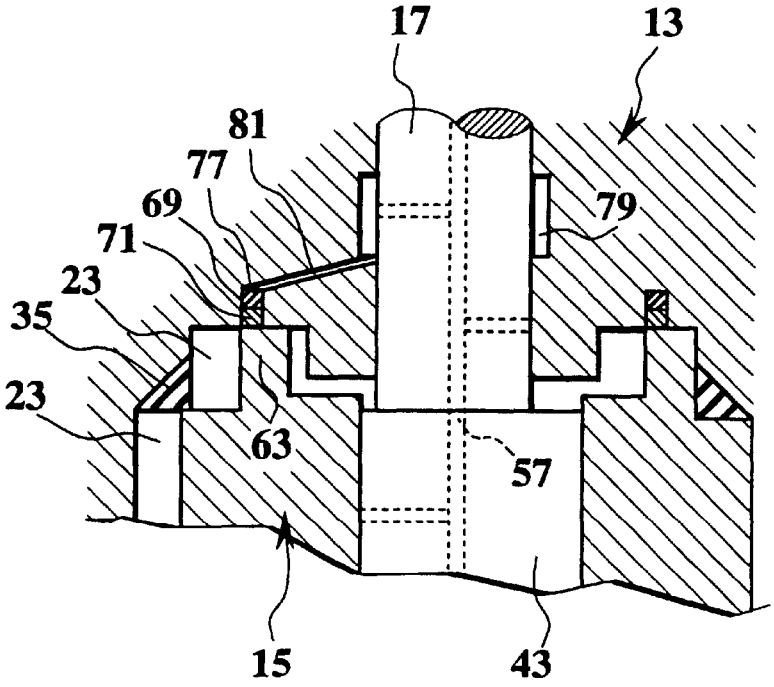
FIG. 9 is an enlarged sectional view showing a pertinent portion wherein an elastic member is provided on a bottom of an annular groove into which the annular member is to be fitted, and also a lubricating oil is supplied to the bottom of the annular groove.

In addition, as shown in FIG. 9, in the embodiment wherein the annular member 71 is provided, preferably an elastically deformable elastic member 77 made of elastic material such as rubber, etc., should be provided on a bottom of the annular groove 69, and in addition a lubricating oil supplied from an oil reservoir 79 via a lubricating passage 57 should be supplied to the bottom of the annular groove via lubrication guidepaths 81. In this event, the oil reservoir 79 may be provided on the crankshaft 17 side which can connect the lubrication guidepaths 81 mutually.

Accordingly, the annular member 71 can be brought slidably into contact with the projecting portion 63 of the moving spiral 15 side without fail, and the smooth sliding working surface can also be obtained stably for a long period of time without seal leakage.

Figure 10:
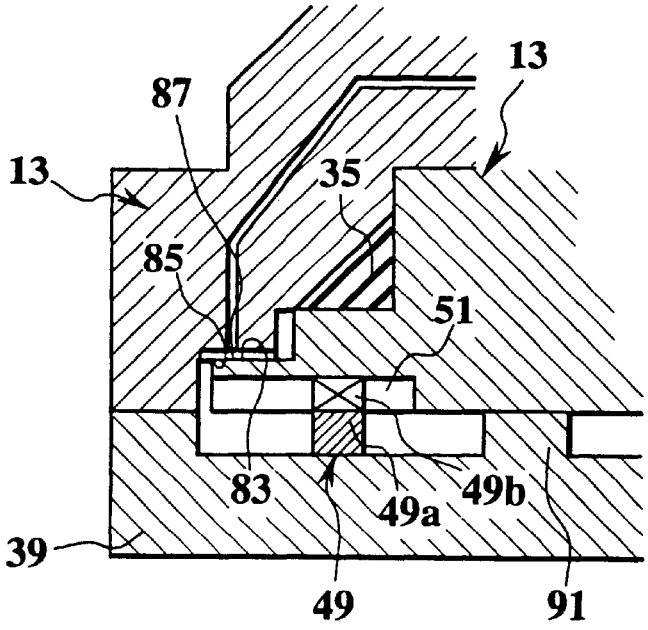
FIG. 10 is an enlarged sectional view showing a pertinent portion wherein an upper outer peripheral surface of the moving spiral is received by a lower outer peripheral surface of the stationary spiral.

FIG. 10 shows a configuration wherein an upper outermost peripheral surface 83 of the moving spiral 15 is received by a lower outermost peripheral surface 85 of the stationary spiral 13. Even if a large deviated load acts during the rotational motion of the moving spiral 15, an overturn moment can be suppressed smaller so that an axial position of the moving spiral 15 can be held correctly. In the case of this embodiment, it is preferable that an oil groove 87 to which the lubricating oil is supplied from the lubricating passage 57 is provided on either one of the upper outermost peripheral surface 83 and the lower outermost peripheral surface 85 so as to ensure smooth slide of the sliding working surface for a long term.

Figure 12:
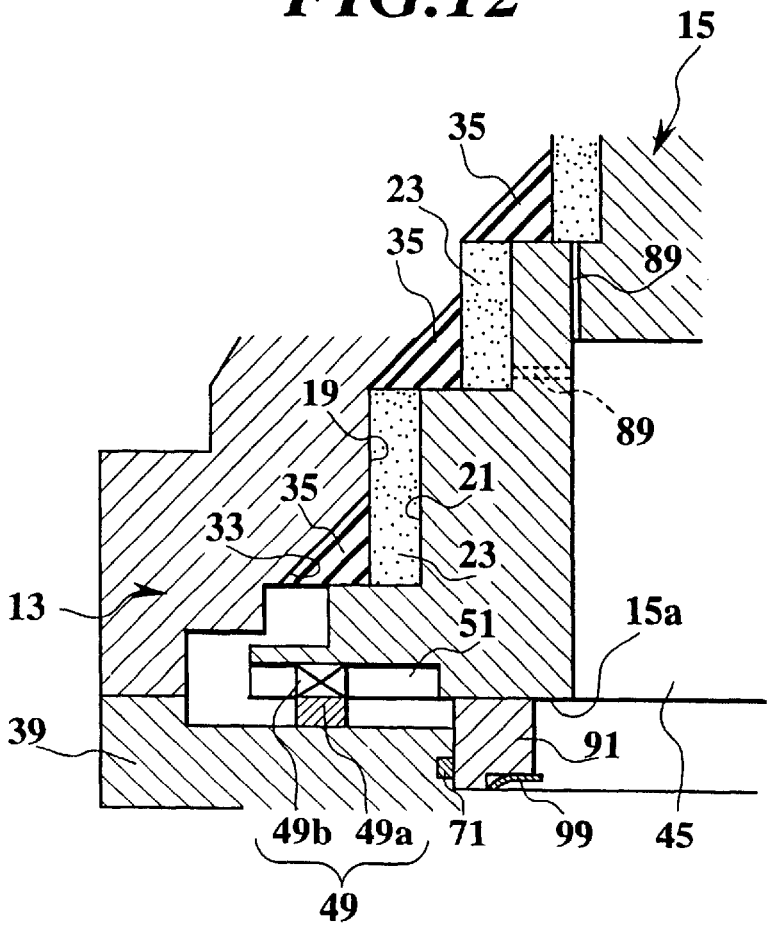
FIG. 12 is an enlarged sectional view showing a pertinent portion wherein gas passages for guiding a pressure of the compressed gas are provided.

Meanwhile, there are a suction gas pressure and a compression gas pressure as the gas pressure for pushing the moving spiral 15 to the stationary spiral 13. In this embodiment, as shown in FIG. 12, the compression gas pressure is guided to the rear surface of the moving spiral via a gas passage 89 and an internal space 45. Such gas passage 89 is provided orthogonally with a vertical surface or a horizontal surface of the outer engaging surface 21, which is formed to have a stepwise sectional shape, of the moving spiral 15.

It is preferable in the aspect of workability that, since its machining can be facilitated, the gas passage 89 should be provided through the vertical surface which intersect orthogonally with the horizontal surface. In addition, if a diameter of the gas passage 89 is narrowed, changing the pressure which is applied to the rear surface 15*a* of the moving spiral 15 becomes difficult when the pressure of the compression chamber 23 is varied. Therefore, the stable gas pressure for the rear surface 15*a* can be accomplished. Furthermore, if outer open end portions of the gas passage 89 are chamfered, trouble in sliding the moving spiral 15 due to flash or the like can be eliminated.

Figure 11:
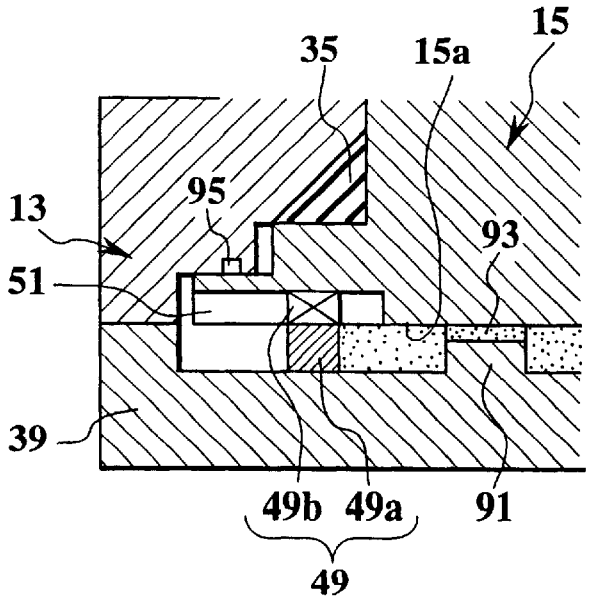
FIG. 11 is an enlarged sectional view showing a pertinent portion wherein an annular member is provided on the lower outer peripheral surface of the stationary spiral in FIG. 10.

As shown in FIG. 11, the gas pressure guided to the rear surface of the moving spiral 15 can apply circularly or annularly via a connecting passage 93 which is formed on an upper surface of an annular receiving portion 91 to support the rear surface 15*a* of the moving spiral 15. As shown on FIG. 12, such annular receiving portion 91 may be formed separately from the supporting frame. In this case, it is preferable that an upper surface of the annular receiving portion 91 should be formed such that the smooth sliding working surface can be provided by an energizing member 99 and that an outer peripheral surface of the annular receiving portion 91 should be formed such that the tight sealing surface can be provided by an annular member 71.

Figure 13:
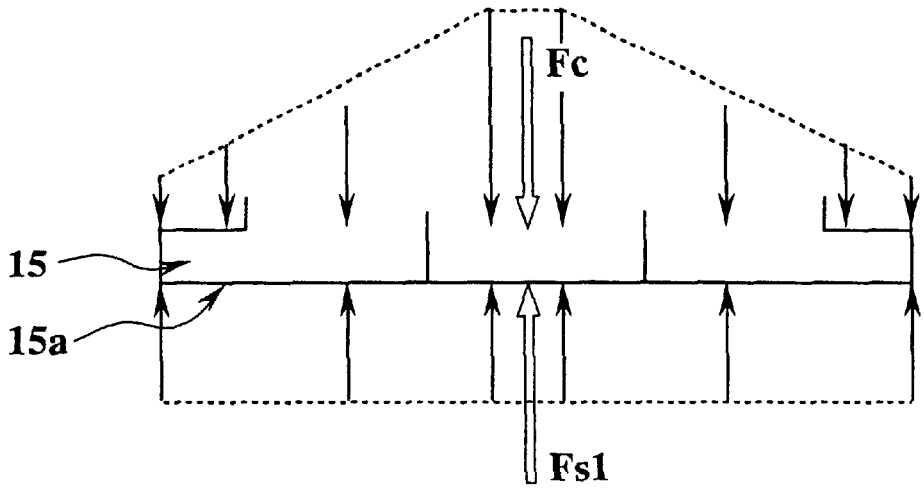
FIG. 13 is a diagram showing distribution of a single gas pressure acting upon the moving spiral.

FIG. 13 shows distribution of a gas pressure acting upon the moving spiral 15. The gas pressure generated in the compression chamber 23 can act upon the moving spiral 15. Respective levels of the gas pressures are selected such that a relationship between a resultant force Fc of the gas pressure and a resultant force Fs1 of the pressure of the compressed gas acting upon the rear surface 15*a* of the moving spiral 15 is set to $Fc \leqq Fs1$. In this case, preferably the gas pressure which exceeds at least the suction gas pressure should be applied to the rear surface 15*a* of the moving spiral 15.

According to the fluid machinery constructed as above, when the moving spiral 15 is rotated with respect to the stationary spiral 13 while the inner engaging surface 19 is brought into contact with the outer engaging surface 21, the compression chamber 23 can be formed with a gradual reduction in volume from the outer peripheral area to the central area.

Since a working volume of the compression chamber 23 can be determined in the radial direction and the height direction at that time, the overall fluid machinery is not increased in size, but a large working volume can be achieved. At the same time, since the moving spiral 15 is pushed to the stationary spiral 13 side by the gas pressure serving as the pushing means, a stable rotational motion of the moving spiral 15 around an axis line X can be ensured even if the deviated load is applied to the moving spiral 15. As a result, the inner engaging surface 19 and the outer engaging surface 21 can be engaged firmly with each other and the highly efficient compression chamber 23 can be derived without seal leakage. In this case, the uniform gas pressure can always be applied to the rear surface 15*a* of the moving spiral 15. Simultaneously, even when overload is imposed upon the moving spiral 15 and thus a force to draw apart the moving spiral 15 from the stationary spiral 13 is caused, the receiving portion 91 can regulate or limit shift amount of the moving spiral 15. Therefore, the receiving portion 91 can provide both a function of releasing such overload and a function of restoring the moving spiral 15 to its compression operation quickly.

The connecting passage 93 provided on the receiving portion 91 may be formed as a groove for lubrication. In this case, reliability of operation can be improved since lubrication can be mare between the receiving portion 91 and the rear surface 15*a* of the moving spiral 15 when the rear surface 15*a* slides on the receiving portion 91 in operation. However, as shown in FIG. 11, a sealing member 95 must be arranged between the outer peripheral end surface and the outer peripheral upper surface. In addition, if the compression gas pressure is lower than the discharge gas pressure, another sliding working surfaces (not shown) must also be sealed.

Figure 14:
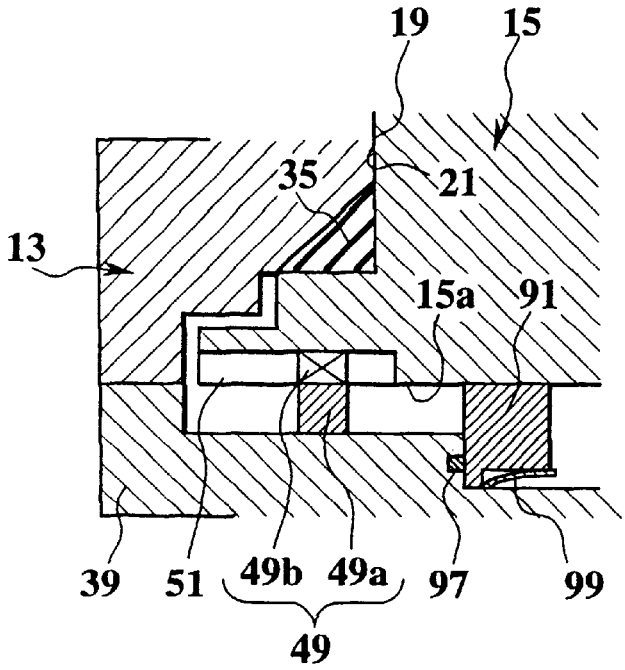
FIG. 14 is an enlarged sectional view showing a pertinent portion wherein a receiving portion for supporting a rear surface of the moving spiral is formed separately from a supporting frame.
Figure 17:
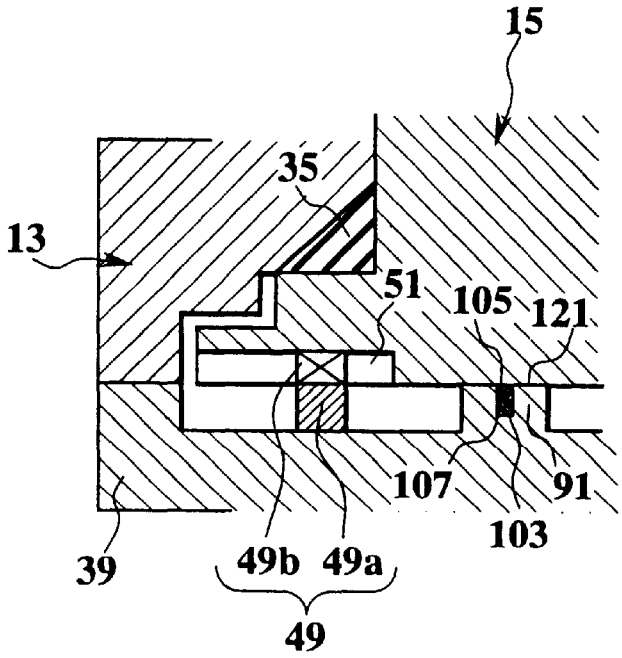
FIG. 17 is an enlarged sectional view showing a pertinent portion wherein a receiving portion which is formed integrally with the supporting frame is provided on an inside of an Oldam's ring.

FIG. 14 shows an example wherein the compression gas pressure is guided into the inside (right side In FIG. 14) of the receiving portion 91 and the suction gas pressure is guided into the outside (left side in FIG. 14) of the receiving portion 91. At that time, preferably the receiving portion 91 should be formed separately from the supporting frame 39. A sealing member 97 is provided on the contact surface side of the supporting frame 39 between the receiving portion 91 and the supporting frame 39. An energizing member 99 for pushing the receiving portion 91 against the rear surface 15*a* of the moving spiral 15 is also provided in a notched bottom portion of the receiving portion 91. Consequently, a sealing configuration which is movable along the axial direction and can be brought into tight contact with the rear surface 15*a* of the moving spiral 15 can be provided by the receiving portion 91. However, as shown in FIG. 17, an annular member 71 shown in FIG. 7 may be provided such that it is movable along the axial direction and it can be brought into tight contact with the rear surface 15*a* of the moving spiral 15 if the receiving portion 91 is formed integrally with the supporting frame 39, as shown in FIG. 10. Therefore, the annular member 71 is pressed against the side wall due to differential pressure to thus provide a sealable configuration, so that leakage can be prevented and thus no problem is caused.

Figure 15:
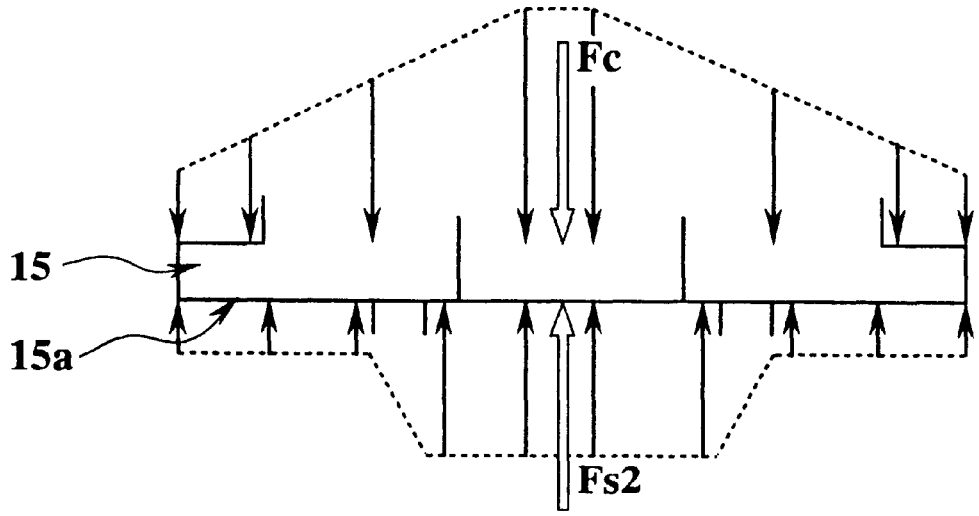
FIG. 15 is a diagram showing distribution of plural gas pressures acting upon the moving spiral.

If the pressure of the compression gas in the inside of the receiving portion 91 is lower than that of the discharge gas, the sealing structure is needed on respective sliding working surfaces. Distribution of the gas pressures acting upon the moving spiral 15 at that time is shown in FIG. 15. A level of the gas pressure applied to the rear surface 15*a* of the moving spiral 15 and a diameter of the receiving portion 91 are selected such that a relationship between a resultant force Fc of the gas pressure generated in the compression chamber 23 and a resultant force Fs2 of the gas pressure acting upon the rear surface 15*a* of the moving spiral 15 is set to $Fc \leqq Fs2$. In addition, if a plurality of receiving portions 91 are formed and the compression gases are then guided separately therebetween, difference between a force caused by the gas pressure generated in the compression chamber 23 and a force caused by the gas pressure which is applied to the rear surface 15*a* of the moving spiral 15 can always be maintained at an almost constant value under various operational conditions. As a result, if whichever condition is selected, an optimum resultant force Fs2 to meet the condition can be selected.

Figure 16:
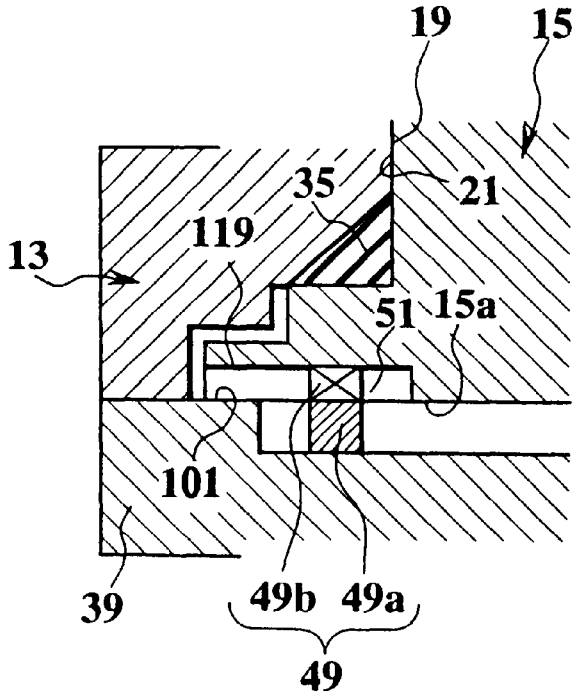
FIG. 16 is an enlarged sectional view showing a pertinent portion wherein a rear surface of the moving spiral which is pushed toward the anti-stationary spiral is received by a receiving portion of the supporting frame.
Figure 18:
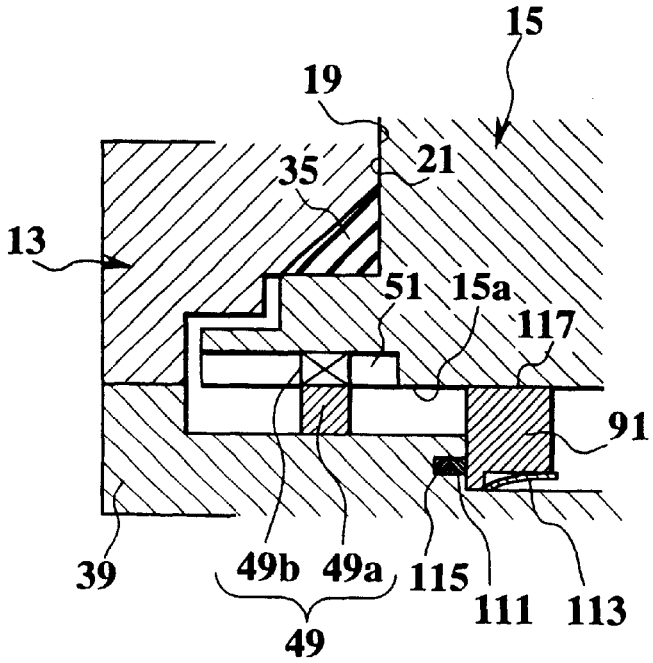
FIG. 18 is an enlarged sectional view showing a pertinent portion wherein, like the pertinent portion shown in FIG. 10, the receiving portion is formed separately with the supporting frame.

FIGS. 16 to 18 show respective embodiments wherein the rear surface 15*a* of the moving spiral 15 is pushed against the anti-stationary spiral 13 side.

FIG. 16 shows a configuration wherein a receiving portion 101 is formed on an outer peripheral area of the supporting frame 39 and the rear surface 15*a* of the moving spiral 15 is also brought into contact with this receiving portion 101 of the supporting frame 39. In this case, it is preferable to form an oil groove for lubrication on the receiving portion 101 to which the rear surface 15*a* of the moving spiral 15 contacts. Consequently, insufficient lubrication can be prevented during operation and also sliding loss can be reduced.

FIG. 17 shows a configuration wherein the receiving portion 91 is formed in the inner area of an Oldam's ring 49 on the supporting frame 39 so as to contact to the rear surface 15*a* of the moving spiral 15. In this case, the Oldam's ring 49 can execute a reciprocating motion but is never submerged in the oil, so that the compressor with less loss can be provided. In addition, in the event that plural gases with different pressures are guided to the inside and the outside of the receiving portion 91 respectively, they can be employed commonly as the sealing means on the sliding working surface of the receiving portion 91. Therefore, a thrust force of the moving spiral 15 can be controlled with a simple configuration. In the case of this embodiment, in order to improve the sealing effect further more, an annular groove 103 is formed on an upper surface of the receiving portion 91 and a sealing member 105 may then be inserted into the annular groove 103. If an elastic member 107 is provided at need between a sealing member 105 and a bottom of the annular groove 103, the sealing effect can be increased much more.

As shown in FIG. 18, the receiving portion 91 may be formed as a separate part with the supporting frame. Thereby, its machining can be made easy and management of the dimensional precision of the receiving portion 91 can be facilitated. If the gas pressure is made different in the inside and the outside of the receiving portion 91, a leakage loss of the gas can be eliminated by providing a sealing member 111 on the outside of the receiving portion 91 and providing an energizing member 113 in a notched portion of the bottom of the receiving portion 91, and consequently a high efficiency can be achieved. In addition, in this case, if an elastic member 115 is provided on the bottom portion of the sealing member 111, tight contact of a sliding working surface 117 can be ensured because of the effect achieved by the elastic member 115 even when the moving spiral 15 receives the deviated load to thus generate the overturn moment in operation. Although the receiving portion 91 is provided on the supporting frame 39 side in the configuration shown in this embodiment, it may be provided on the moving spiral 15 side. At that time, these effects are not changed.

Next, an operation for pushing the moving spiral 15 to the anti-stationary spiral 13 side will be explained hereunder.

In case a single gas is guided to the rear surface 15*a* of the moving spiral 15, the gas having the gas pressure which is lower than that of the discharge gas must be guided. As an example, a means for guiding the pressure of the suction gas can be considered. In this case, the pressure of the suction gas can be guided to the rear surface 15*a* by filling the hermetic case 1 by the suction gas. In this event, a sealing structure is not needed on the sliding working surface 119 between the outer peripheral end surface and the outer peripheral upper surface. At that time, the levels of the gas pressures at the rear surface 15*a* are selected such that a relationship between a total gas pressure Fc in the compression chamber 23 and a gas pressure Fs1 of the compressed gas acting upon the rear surface 15*a* of the moving spiral 15 is set to $Fc \leqq Fs1$ in FIG. 13.

In case two kinds of gas pressures are guided to the rear surface 15*a* of the moving spiral 15, the pressure of the compression gas is introduced to the inside of the receiving portion 91 while the pressure of the suction gas is introduced to the outside of the receiving portion 91, as in the configuration shown in FIGS. 17 and 18. A sliding working surface 124 may be consisted of flat planes without a special sealing structure to be provided therebetween, but preferably the sealing structure should be provided to the sliding working surface 124. Hence, leakage can be prevented much more and a higher performance can be achieved. In case the flat planes come slidably in contact with each other, a surface roughness of both flat planes with precision higher than 32S is needed and a flatness of both flat planes with precision lower than 20 $\mu$m is also needed. In this embodiment where plural gas pressures are introduced, respective levels of the gas pressures at the rear surface 15*a* and the diameter of the receiving portion 91 are selected such that a relationship between a total gas pressure Fc in the compression chamber 23 and a resultant force Fs2 of the gas pressure acting upon the rear surface 15*a* of the moving spiral 15 is set to $Fc \geqq Fs2$ in the configuration shown in FIG. 15. Accordingly, when the moving spiral 15 is pushed toward the anti-stationary spiral 13 side, the rear surface 15*a* of the moving spiral 15 can be supported by the receiving portion 91. Consequently, even if the deviated load is imposed upon the moving spiral 15, a stable rotational motion of the moving spiral 15 can be assured and the efficient compression chamber 23 with less seal leakage can be implemented.

In the above embodiments, the gas pressure has been used as the pushing means. However, such pushing means is not limited to the gas pressure, and another means such as energizing member, etc. may be employed.

In addition, the fluid machinery of the present invention is not limited to the compressor. For example, the fluid machinery of the present invention may be employed as an expander, pump, etc.

As described in detail above, according to the fluid machinery of the present invention, if the deviated load is imposed upon the moving spiral in operation, the stable rotational motion of the moving spiral can be attained. As a result, the efficient compression chamber 23 with less seal leakage can be implemented.

Moreover, according to the fluid machinery of the present invention, the volume of the working chamber can be determined along the radial direction and the height direction. Therefore, the large working volume can be derived without an increase of the overall fluid machinery in size. In addition, since the engaging surfaces can be formed of only two surfaces, i.e., the inner engaging surface and the outer engaging surface, the machining can be facilitated and therefore the present invention is extremely preferable in the aspect of workability.

While the above provides a full and complete disclosure of the preferred embodiments of the present invention, various modifications, alternate constructions and equivalents may be employed without departing from the scope of the invention. Therefore the above description and illustration should not be construed as limiting the scope of the invention which is defines by the appended claims.

What is claimed is:

1. A fluid machinery comprising:

a stationary spiral having an inner engaging surface that rises spirally from its inner periphery to its center and has a stepwise sectional shape;

a moving spiral having an outer engaging surface that rises spirally from its outer periphery to its center and has a stepwise sectional shape, the moving spiral being rotatable about an axis relative to the stationary spiral;

a plurality of working chambers formed between the outer engaging surface of the moving spiral and the inner engaging surface of the stationary spiral, the working chambers decreasing in volume as the working chambers approach toward the center of the stationary spiral;

pushing means for pushing the moving spiral toward the stationary spiral along the axis;

a spiral sealing member provided between the inner engaging surface of the stationary spiral and the outer engaging surface of the moving spiral, for sealing and isolating the working chambers from one another, wherein the pushing means urges the outer engaging surface of the moving spiral against the inner engaging surface of the moving spiral to improve sealing and isolate the working chambers from one another during normal operation, and wherein the pushing means allows the moving spiral to move away from the stationary spiral against the urging of the pushing means when the working chambers are at an abnormally high pressure to reduce pressure in the working chambers.

2. A fluid machinery according to claim 1, wherein the pushing means comprises gas pressures pushing the moving spiral toward the stationary spiral.

3. A fluid machinery according to claim 2, further including a gas passage that allows the gas pressures to apply to a rear surface of the moving spiral in at least one of a vertical surface side and a horizontal surface side of the stepwise sectional shaped outer engaging surface of the moving spiral.

4. A fluid machinery according to claim 2, wherein the gas pressures are applied circularly or annularly to a rear surface of the moving spiral.

5. A fluid machinery according to claim 4, wherein the gas pressures include both a suction gas pressure and a compression gas pressure.

6. A fluid machinery according to claim 5, wherein the compression gas pressure that exceed the suction gas pressure is applied to the rear surface of the moving spiral.

7. A fluid machinery according to claim 6, further including an annular receiver that receives the rear surface of the moving spiral, the annular receiver forming a sliding working surface, and a sealing member, the sealing and sliding working surfaces defining and sealing a gas pressure applying area, the compression gas pressure in excess of the suction gas pressure being applied to the gas pressure applying area.

8. A fluid machinery according to claim 2, further including an annular receiver that receives a rear surface of the moving spiral, the annular receiver forming a sliding working surface that partitions the gas pressure.

9. A fluid machinery according to claim 8, further comprising a ring sealing member contacting the sliding working surface of the annular receiver and the rear surface of the moving spiral.

10. A fluid machinery according to claim 9, wherein the ring sealing member is energized toward a rear surface side of the moving spiral by an energizing member.

11. A fluid machinery according to claim 1, wherein the moving spiral has a bearing portion and the stationary spiral has a bearing portion, an upper surface of the bearing portion of the moving spiral is received on the lower surface of the bearing portion of the stationary spiral.

12. A fluid machinery according to claim 11, further including a sealing member on a sliding working surface between the upper surface of the bearing portion of the moving spiral and the lower surface of the bearing portion of the stationary spiral for sealing the sliding working surface.

13. A fluid machinery according to claim 11, further comprising a wear resistance material which is provided between an outer upper surface of the bearing of the moving spiral and an inner lower surface of the bearing of the stationary spiral.

14. A fluid machinery according to claim 13 , wherein the wear resistance material is made of a Swedish steel or spring member.

15. A fluid machinery according to claim 11, further comprising:

an annular groove provided in one of the upper surface of the bearing portion of the moving spiral and the lower surface of the bearing portion of the stationary spiral; and an annular member inserted into the annular groove and movable in its axial direction.

16. A fluid machinery according to claim 15, wherein the annular member has a cut line for connecting an inner diameter side and an outer diameter side.

17. A fluid machinery according to claim 15, further comprising an elastically deformable elastic member seated on a bottom of the annular groove, before seating the annular member.

18. A fluid machinery according to claim 17, wherein the annular groove is adopted to receive oil stored in an oil reservoir.

19. A fluid machinery according to claim 1, wherein an upper outermost peripheral surface of the moving spiral is received by an lower outermost peripheral surface of the stationary spiral.

20. A fluid machinery according to claim 19, further comprising an oil groove for lubrication provided in either one of the upper outermost peripheral surface of the moving spiral and the lower outermost peripheral surface of the stationary spiral.

21. A fluid machinery comprising:

a stationary spiral having an inner engaging surface that rises spirally from its inner periphery to its center and has a stepwise sectional shape, wherein the stationary spiral is composed of an anti-stationary spiral;

a moving spiral having an outer engaging surface that rises spirally from its outer periphery to its center and has a stepwise sectional shape, the moving spiral being rotatable about an axis relative to the stationary spiral;

a working chamber formed between the outer engaging surface of the moving spiral and the inner engaging surface of the stationary spiral, the working chamber decreasing in volume as the working chamber approaches toward the center of the stationary spiral;

pushing means for pushing the moving spiral along the axis toward the anti-stationary spiral;

a supporting frame for supporting the stationary and moving spirals and having a contact surface;

an annular receiving portion on the supporting frame for supporting a rear surface of the moving spiral, the annular receiving portion having a partially notched bottom surface;

annular sealing member provided between an outer peripheral surface of the annular receiving portion and the contact surface of the supporting frame; and an energizing member provided between the partially notched bottom surface of the receiving portion and the supporting frame.

22. A fluid machinery according to claim 21, wherein the supporting frame has an annular groove and the annular sealing member is seated in the annular groove, further comprising an elastically deformable elastic member seated on a bottom of the annular groove, before seating the annular sealing member.

* * * * *